US011094300B2

(12) United States Patent
Janowski

(10) Patent No.: US 11,094,300 B2
(45) Date of Patent: Aug. 17, 2021

(54) STRINGED INSTRUMENT WITH OPTIMIZED ENERGY CAPTURE

(71) Applicant: Paul Janowski, Broadbent, OR (US)

(72) Inventor: Paul Janowski, Broadbent, OR (US)

( * ) Notice: Subject to any disclaimer, the term of this patent is extended or adjusted under 35 U.S.C. 154(b) by 0 days.

(21) Appl. No.: 16/747,913

(22) Filed: Jan. 21, 2020

(65) Prior Publication Data

US 2020/0243051 A1 Jul. 30, 2020

Related U.S. Application Data

(60) Provisional application No. 62/796,661, filed on Jan. 25, 2019.

(51) Int. Cl.

| | |
|---|---|
| ***G10D 3/13*** | (2020.01) |
| ***G10D 3/147*** | (2020.01) |
| ***G10D 1/08*** | (2006.01) |

(52) U.S. Cl.

CPC ..... *G10D 3/13* (2020.02); *G10D 1/08* (2013.01); *G10D 3/147* (2020.02)

(58) Field of Classification Search

CPC ..... G10D 3/13; G10D 3/147; G10D 1/08; G10D 3/10

See application file for complete search history.

(56) References Cited

U.S. PATENT DOCUMENTS

| | | | | |
|---|---|---|---|---|
| 5,208,410 | A | 5/1993 | Foley | |
| 5,347,905 | A | 9/1994 | Cipriani | |
| 5,404,783 | A | 4/1995 | Feiten et al. | |
| 7,326,839 | B2 | 2/2008 | Konishita | |
| 7,327,109 | B1 | 2/2008 | Hagen | |
| 7,554,023 | B2 | 6/2009 | Tyler | |
| 7,563,968 | B2 | 7/2009 | Medas | |
| 8,076,559 | B2 | 12/2011 | Toone | |
| 8,344,231 | B2 | 1/2013 | Hamilton | |
| 9,299,324 | B2 * | 3/2016 | van Ekstrom | G10D 3/153 |
| 2007/0131082 | A1 | 6/2007 | Feiten et al. | |
| 2012/0103171 | A1 | 5/2012 | Lashbrook | |
| 2016/0240174 | A1 * | 8/2016 | Stanley | G10D 3/12 |

* cited by examiner

*Primary Examiner* — Kimberly R Lockett
(74) *Attorney, Agent, or Firm* — Hall Estill Law Firm

(57) ABSTRACT

A stringed instrument, such as an acoustic, electric, or semi-acoustic electric guitar or bass, can employ a stringpath assembly that consists of a tail structure connected to a head structure via a plurality of strings with the tailpiece consisting of a body disposed between a bridge mechanically fastened to a tailpiece with each string of the plurality of strings continuously extending from the bridge through the body to the tailpiece to efficiently capture vibration of the plurality of the strings.

20 Claims, 3 Drawing Sheets

STRINGED INSTRUMENT WITH OPTIMIZED ENERGY CAPTURE

RELATED APPLICATION

The present application makes a claim of domestic priority to U.S. Provisional Patent Application No. 62/796,661 filed Jan. 25, 2019, the contents of which are hereby incorporated by reference.

SUMMARY

A stringed instrument, in some embodiments, has a stringpath assembly consisting of a tail structure connected to a head structure via a plurality of strings with the tailpiece consisting of a body disposed between a bridge mechanically fastened to a tailpiece with each string of the plurality of strings continuously extending from the bridge through the body to the tailpiece to efficiently capture vibration of the plurality of the strings.

In other embodiments, a stringed instrument has a plurality of strings suspended over a body between a saddle and a nut with each string physically attached to the body via a tail structure and to a headstock via a head structure. The tail structure defines an enclosed and continuously curvilinear string channel extending from a tailpiece through the body to a bridge member.

A stringed instrument, in accordance with various embodiments, is utilized by attaching a tail structure to a body with the tail structure defining an enclosed and continuously curvilinear string channel extending from a tailpiece through the body to a bridge member. One or more strings are inserted into the string channel so that a string extends from the string channel to contact a saddle and a nut. Movement is induced in the string to produce a predetermined sound with the movement corresponding to a predetermined stringpath in response to the configuration of the tail structure.

DETAILED DESCRIPTION

The present disclosure generally relates to structures that optimize the acoustic characteristics of a stringed instrument. Such structures provide an improved means of capturing the energy of a vibrating string at both ends of a stringed instrument so more energy is transmitted to the point of transduction, whether by electronic, acoustic, or other means.

Figure 1:
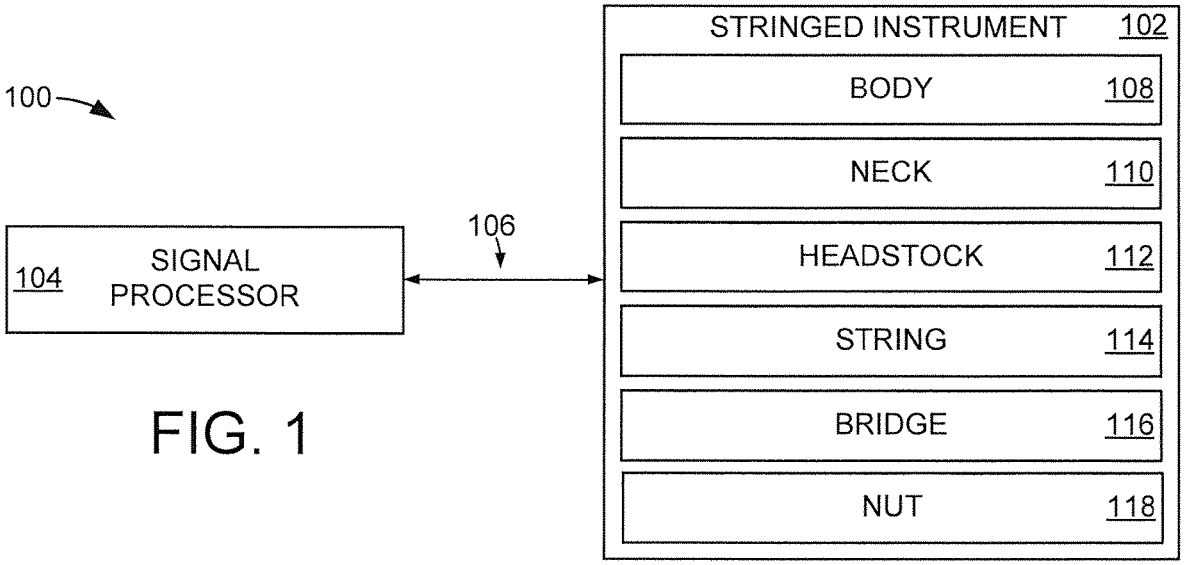
FIG. 1 displays a block representation of an example stringed instrument assembly that may be employed in accordance with various embodiments.

An example stringed instrument assembly 100 is conveyed in FIG. 1 and has a stringed instrument 102 connected to one or more signal processors 104. As a non-limiting example, multiple different stringed instruments 102, such as a six-string guitar and a four-string bass, can each be connected to different signal processors 104, such as a foot pedal, while each being connected to a common signal processor 104, such as a sound board, amplifier, or pre-amp, via one or more connections 106, such as a wired and/or wireless signal pathway.

A stringed instrument 102 is not limited to a particular size, shape, type, sound characterization, or material construction, but can in some embodiments be guitar defined at least by a body 108 affixed to a neck 110 that presents a headstock 112. One or more strings 114, such as metal, nylon, or other acoustic material, can continuously extend from a headstock 112 to a bridge 116 across a nut 118 of the neck 110 and portions of the body 108. Articulation of at least one string 114 produces a predetermined tone and frequency range that can be enhanced by the body 108, signal processor 104, or both. For instance, an acoustic guitar/bass can have no electronic transducing means and rely on the body 108 to reverberate sound generated by the string(s) 114 while an electric guitar can have minimal acoustic chamber in the body 108 and rely on one or more active or passive electronic transducing means, such as a wound coil pickup, humbucking pickup, and piezo pickup.

Figure 2:
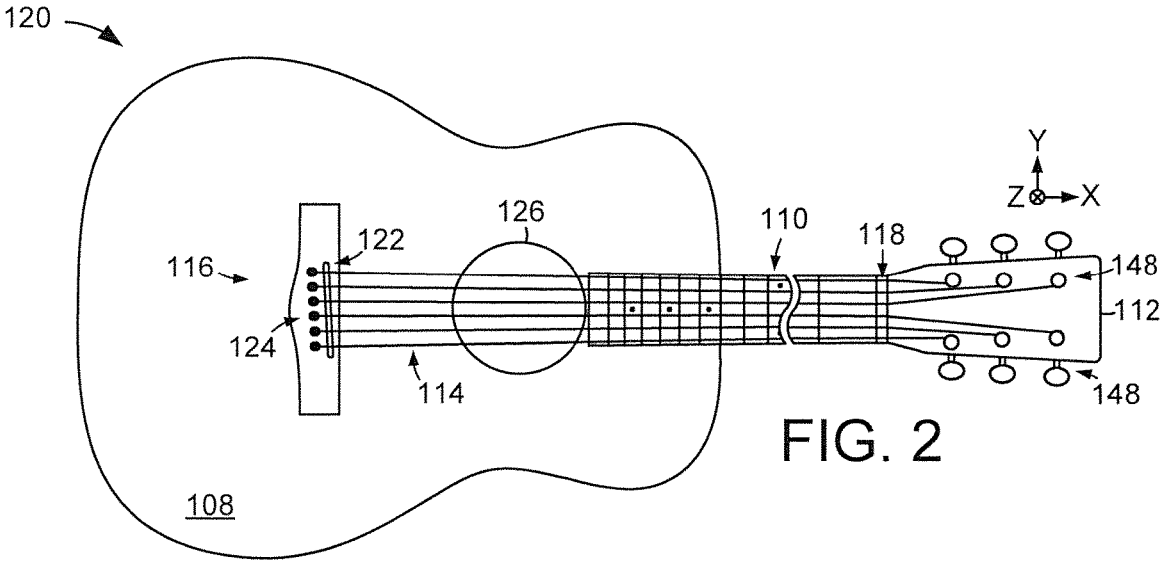
FIG. 2 represents a top view of portions of an example stringed instrument that may be employed in the stringed instrument assembly of FIG. 1.

FIG. 2 displays a line representation of portions of an example acoustic stringed instrument 120 that can be employed in the stringed instrument assembly 100 in accordance with various embodiments. The instrument body 108 supports the neck 110 and the bridge 116 so that multiple separate strings 114 can be suspended across the saddle 122 and nut 118. Although not required, each string 114 can be mounted to the bridge 116 via a retention feature 124, which can be any securing structure, such as a protrusion, ball, or fastener, contacting the string 114 to physically retain the string 114 relative to the saddle 122 and nut 118.

As shown, the respective strings 114 can be suspended over a soundhole 126 that allows for reverberation of the interior cavity of the body 108 to add to the tonal characteristics of the instrument 120 as a result of vibrating strings 114. Such reverberation can be controlled with the interior volume of the body 108, the material of the body 108, and the size of the soundhole 126. While the tonal properties of an acoustic instrument can be unique and desired, some stringed instruments rely on electronic means for tonal characteristics.

Figure 3:
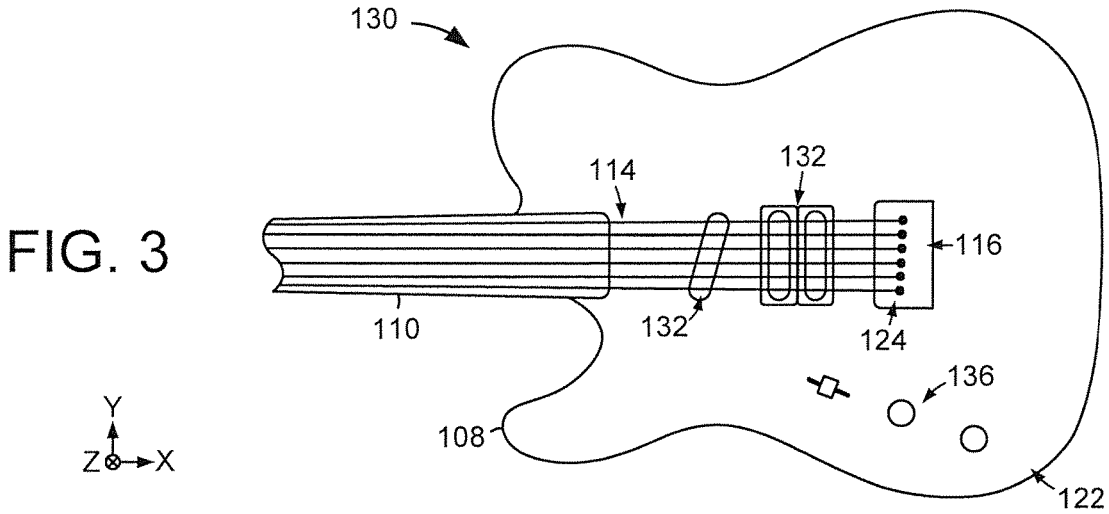
FIG. 3 illustrates a line representation of portions of an example stringed instrument that can be employed in the stringed instrument assembly of FIG. 1.

The example electric stringed instrument 130 of FIG. 3 conveys how the soundhole 126 of instrument 120 can be replaced by one or more electric pickups 132/134. It is contemplated that any number, type, and size of electric pickup 132/134 can be utilized by a single instrument 130. As a non-limiting example, a single coil pickup 132 can be employed in conjunction with a humbucking pickup 134, as controlled by one or more electronic tuning means 136. Such electronic tuning means 136 can be knobs, buttons, and switches that act to electronically alter the signal detected by the pickups 132/134 from vibrations of the strings 114.

It can be appreciated that the acoustic stringed instrument 120 can have different tonal characteristics than the electric stringed instrument 130. For instance, the acoustic instrument 120 can have warmer and deeper tone while the electric instrument 130 can have a greater range and customization when plugged into a signal processor 104. When not plugged into a signal processor 104, the electric instrument 130 may have somewhat similar tonal characteristics to the acoustic instrument 120, but the lack of a resonating cavity inhibits acoustic capabilities. Hence, a semi-hollow body electric instrument was created to provide unplugged acoustic properties that resemble the acoustic instrument 120 while providing the control, sound, and range of the solid body electric instrument 130.

Figure 4A:
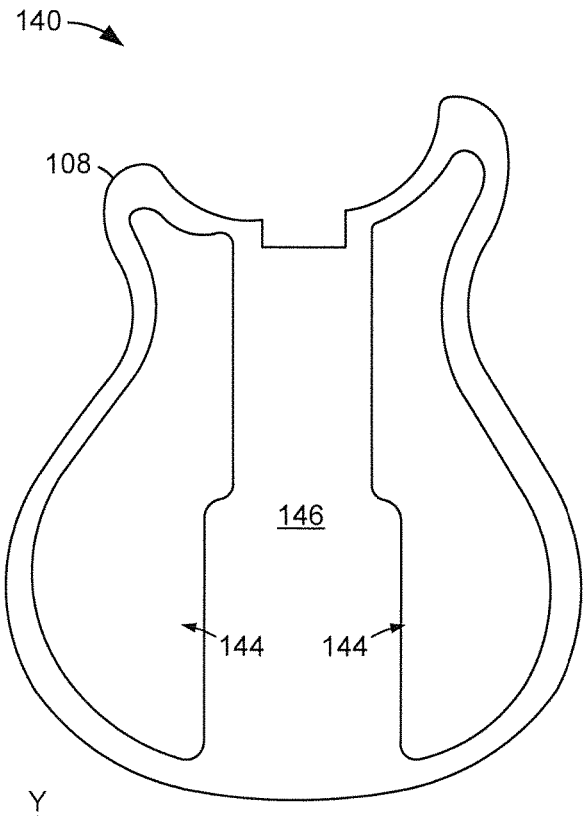
FIGS. 4A & 4B respectively depict line representations of portions of an example stringed instrument that can be utilized in the stringed instrument assembly of FIG. 1.
Figure 4B:
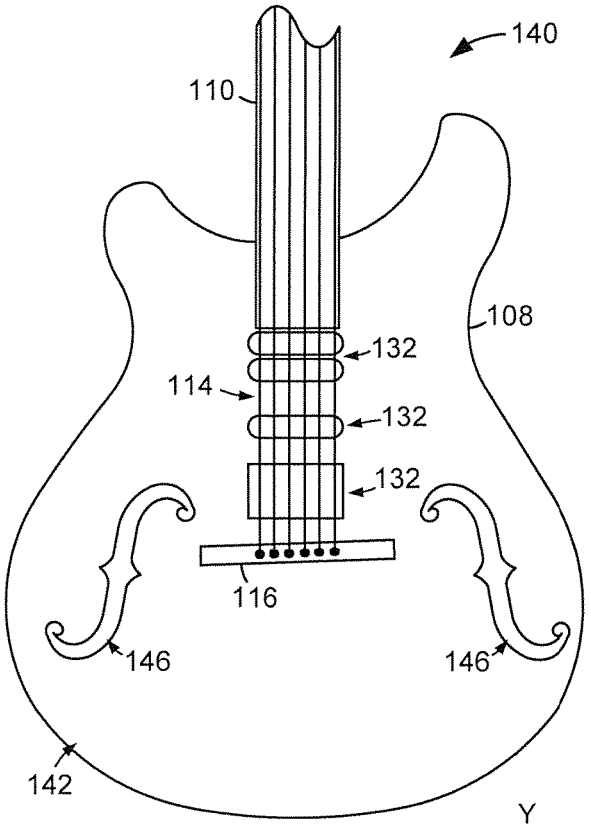

FIGS. 4A and 4B respectively display portions of an example semi-hollow body electric stringed instrument 140 that can be employed in the instrument assembly 100 of FIG. 1. FIG. 4A displays a cut-away perspective of an instrument body 108 and neck 110 without a top cover 142 where a bridge 116 is mounted. The body 108 can be any shape, size, and material construction as part of an electric guitar/bass, but is considered a hollow body electric/semi-acoustic guitar with a relatively thin profile, such as 1.75" or less along the Z axis, a relatively small internal cavity 144 volume, such as 200 cubic inches or less, and internal features 146 for mounting electronics, such as knobs, batteries, circuitry, and pickups.

It is noted that the solid body electric instrument 130 of FIG. 3 differs from the body 108 of the instrument 140 in FIG. 4A by having no acoustically appreciable internal cavity 144 that enhances the acoustic properties of the vibrating strings 114. In contrast, the acoustic instrument 120 of FIG. 2 differs from the body 108 of the instrument 140 in FIG. 4A by having a larger internal cavity 144 that has a shape conducive to enhancing the acoustic properties of the vibrating strings 114. An acoustic instrument 120 would additionally have physical bracing within the cavity 144 to support a top cover while an electric instrument 130 has ample body structure without bracing to support a top cover 142 and aggressive manipulation of the strings 114.

FIG. 4B displays the stringed instrument 140 fully assembled and ready to play music with the top cover 142 installed and strings tuned to a predetermined tension across one or more pickups 132. To take advantage of the volume of air occupying the internal cavity 144, one or more shaped ports 146 can allow air to flow into, and out of, the body 108 to enhance and alter the acoustic properties of the vibrating strings 114. That is, sound waves and air translating through the internal cavity 144 from the strings 114 create harmonics at various different frequencies that would otherwise not be produced by the strings alone, but could be detected by a pickup 132 to allow for signal manipulation and playback via one or more signal processors 104.

While the assorted stringed instruments 120/130/140 can provide different acoustic characteristics, playability, and tonal range, each instrument 120/130/140 can suffer from degraded string 114 retention that results in less than optimal instrument performance. As illustrated in FIGS. 2 & 3, a stringed musical instrument can clamp a string 114 between the retention feature 124 and a tuning feature 148, which provides a means for applying tension to the string 114 to bring it to a certain pitch. The two points of physical contact for a string 114 provided by the saddle 122 and nut 118 at a predetermined distance define a scale length of an instrument.

The stringpath is the path a particular string 114 moves from one end to the other when physically selected, such as through striking, strumming, or scraping, which defines the tonal and musical characteristics of an instrument 120/130/140. Hence, all points along a stringpath of a string 114 provide the acoustic, tonal, and musical characteristics of an instrument. With a string 114 physically secured to an instrument 120/130/140 between the retention 124 and tuning 148 features, string vibration is degraded.

Figure 5A:
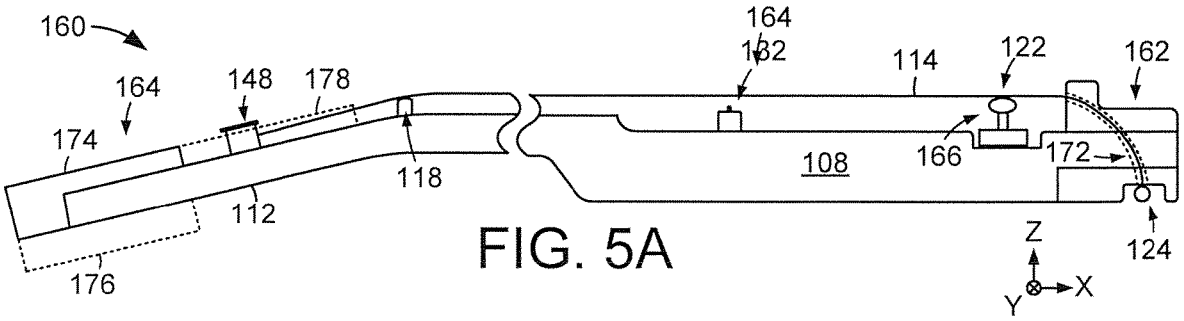
FIGS. 5A and 5B are cross-sectional representations of portions of an example stringed instrument arranged in accordance with various embodiments.
Figure 5B:
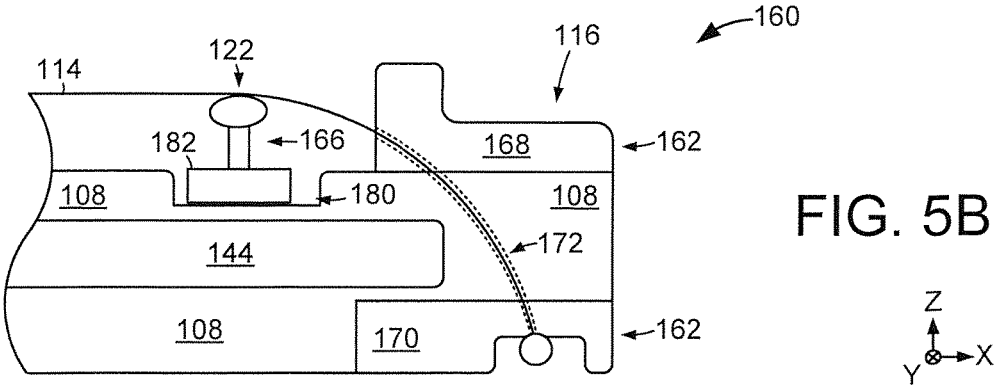

FIGS. 5A and 5B respectively depict cross-sectional line representations of portions of an example stringed instrument 160 in which some embodiments can be practiced. The instrument 160 shown in FIG. 5A employs a tail structure 162 secured to a first end of the body 108 and a head structure 164 secured to the headstock 112. Each structure 162/164, along with the adjustable saddle 166, can be tuned for size, position, shape, and material to customize the stringpath of one or more strings 114 and how the motion of a string 114 contributes to the sound reproduction of the instrument 160.

Each structure 162/164, in some embodiments, are relatively high mass assemblies made of a metal, such as stainless steel, aluminum, tungsten, or a combination of different metals. It is contemplated that the structures 162/164 can be constructed, partially or wholly, of non-metal materials, such as composites, polymers, or rubber, that are relatively high mass compared to the weight of the body 108. The tail structure 162 consists of a bridge member 168 contacting a first side of the body 108 and connected to a tailpiece 170 positioned on an opposite second side of the body 108. The bridge member 168 may be affixed to the tailpiece 170 via one or more fasteners, adhesives, or other securing means that tightly clamps the body 108 so that vibration of a string 114 efficiently translates through the body 108 to the tailpiece 170.

In FIG. 5B, the tail structure 162 has a continuous channel 172 that extends through the bridge member 168, body 108, and tailpiece 170 so that the string 114 continuously contacts material throughout the channel 172 up to the retention feature 124. One or more hollow chambers 144 can be configured in the body 108 to optimize the tonal and vibration characteristics provided by the string 114 continuously contacting the tail structure 162 and body 108. That is, internal body chamber(s) 144 can be constructed with a shape, size, and position that complements the string 114 configuration through the tail structure 162 to customize the sound characteristics of the instrument 160, such as the sustain, loudness, and stringpath.

While the clamping connection of the tail structure 162 on the body 108 provides increased translation of string vibration to the body 108, the performance of a string 114 can be degraded through lost energy proximal the headstock 112. FIG. 5A displays how the head structure 164 can be made to precisely fit the headstock 112. The head structure 164 may be constructed to contact one or more surfaces of the headstock 112, as shown by the solid line headpiece 174. The head structure 164 may comprise more than one component that clamps to opposite sides of the headstock 112, as shown by segmented region 176.

In some embodiments, the headpiece 174 extends to be physically secured to at least one tuning feature 148, as shown by region 178. Such connection ensures a rigid head structure 164 that is tightly clamped to the headstock 112 and tuning feature(s) 148 so that string 114 vibrations are efficiently translated into the material of the headstock 112. By ensuring efficient string vibration translation at both ends of the instrument 160 via the respective high mass structures 162/164, greater amounts of string vibration are retained, which provides greater playability and sustain compared to relatively loose string connections that allow string vibrational energy to radiate away from the body 108.

It is noted that the string channel 172 encloses the string 114 and is continuously curvilinear, but not sharply curved, such as if the string was wrapped around the body 108. The gently curvilinear channel 172 allows the string 114 to make full contact with the high mass bridge member 168 and tailpiece 170 as well as the body 108, which increases the efficiency of the saddle 166, particularly in high volume, violent string movement situations.

Through the customized configuration of the respective structures 162/164, the transmission of string vibrations is more directly applied to the saddle 166. The configuration of the saddle 166 with adjustments for height, along the Z axis, longitudinal position, along the X axis, and transverse position, along the Y axis, allows for customization of the intonation of the instruments as string vibrations are efficiently transmitted to the body 108. In other words, the saddle 166 can be adjustable within a saddle recess 180 so that a saddle plate 182 physically contacts the body 108 to provide efficient string vibration translation into the body 108 in a manner that optimizes intonation of the instrument 160.

Figure 6:
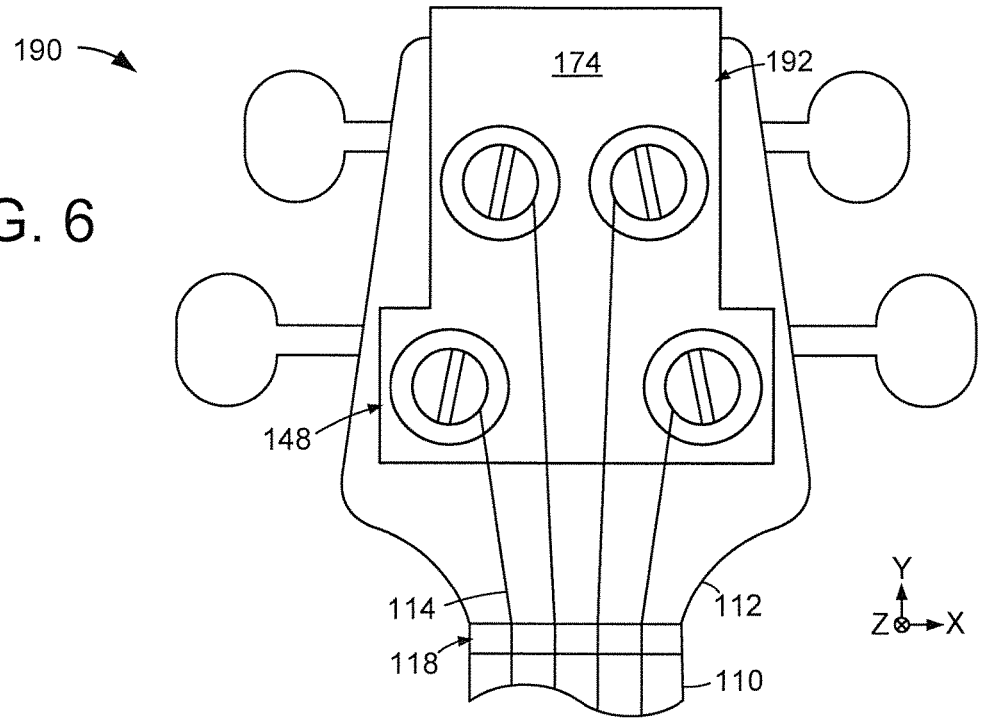
FIG. 6 shows a top view line representation of portions of an example stringed instrument constructed and operated in accordance with various embodiments.

FIG. 6 depicts a top view line representation of a headstock portion of an example stringed instrument 190 arranged with a head structure 192 that optimizes string 114 vibration transmission to produce enhanced instrument sound and playability. The head structure 192 has a single headpiece 174 that extends to physically contact each tuning feature 148 of the headstock 112. It is noted that a four-string bass headstock 112 is shown, but is not required as any number of tuning features 148 can be concurrently engaged by the headpiece 174. It is contemplated that less than all the tuning features 148 of a headstock 112 are mechanically fastened to the headpiece 174 with the screws that tighten the respective strings 114. However, other attachment means may be used alone, or in combination with the tuning features 148 to physically connect the headpiece 174 to the headstock 112.

The ability to control the size and tuning feature 148 engagement of the headpiece 174 allows for the weight, sound, and playability of the instrument 190 to be balanced. That is, a larger headpiece 174 engaging more tuning features 148 can create greater string vibration transmission into the headstock 112, but at the cost of greater weight and lower portability, which can be burdensome during musical performances. Conversely, a smaller headpiece 174 can be lighter weight, but with less string vibration capture and lower sound and/or playability capabilities.

Hence, various embodiments arrange the headpiece 174 of a relatively high mass material that is physically smaller than the headstock 112 in the X-Y plane and physically contacts each tuning feature 148 to provide efficient string vibration capture. However, other embodiments construct the headpiece 174 of lighter weight material with a size that is greater than the physical dimensions of the headstock 112 in the X-Y plane. As such, the head structure 192 is customizable in many ways to control overall instrument sound, playability, and feel.

Figure 7:
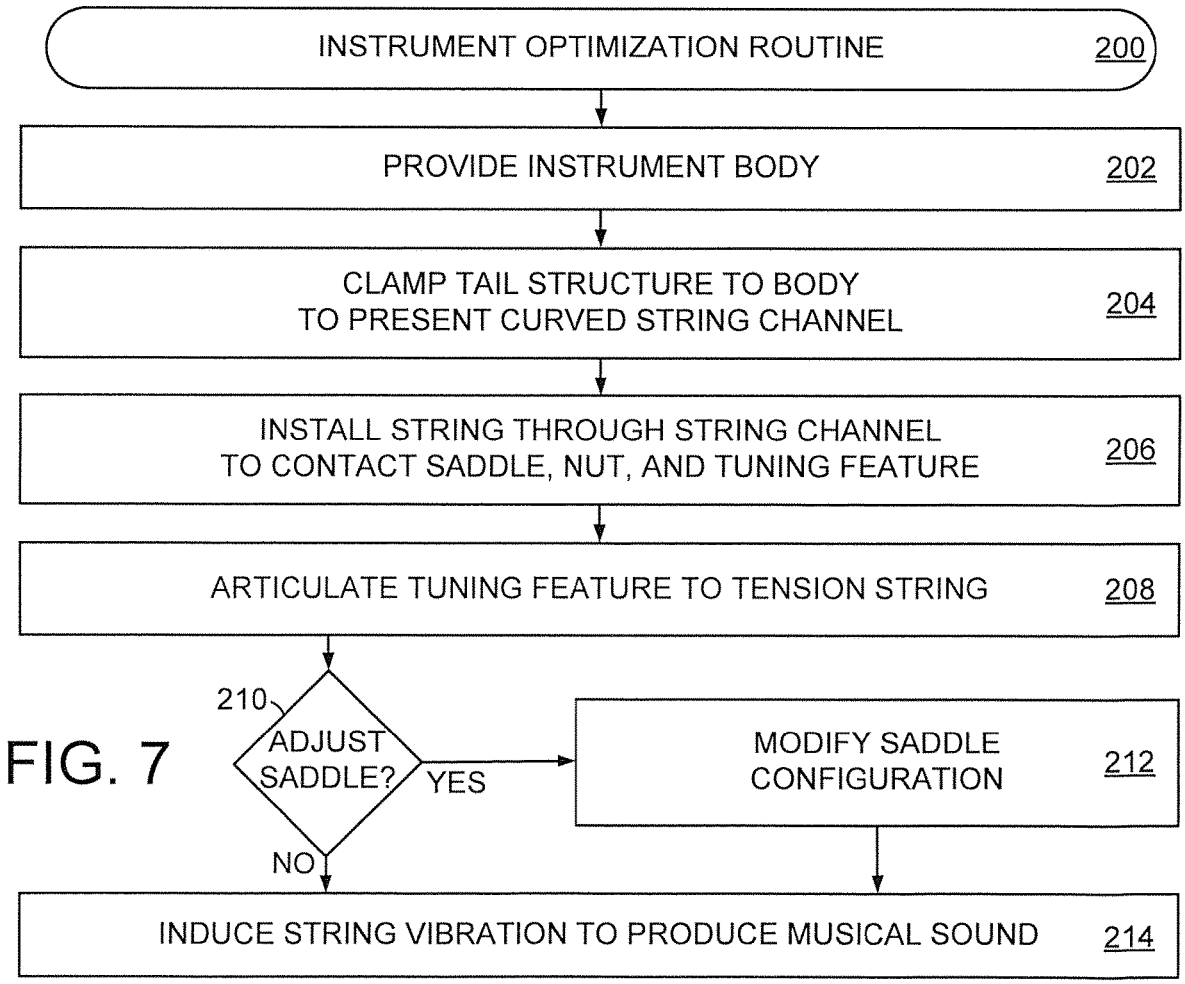
FIG. 7 provides an example instrument optimization routine that can be carried out with the assorted embodiments of FIGS. 1-6.

FIG. 7 is a flowchart of an example instrument optimization routine 200 that can be carried out by the various embodiments of FIGS. 1-6 to provide enhanced stringpath and string vibration capture. The routine begins with step 202 providing an instrument body configured for musical sound production. The instrument body may be an acoustic, electric, or hollow-body electric guitar, bass, or other instrument utilizing strings. Regardless of the configuration of the body, step 204 clamps a tail structure onto the body, which may involve affixing the separate bridge member and tailpiece to each other and/or the body with one or more attachment means, such as adhesive fasteners, or magnets. The attachment of the tail structure in step 204 presents one or more open string channels that continuously extend at a gently curved radius towards an adjustable saddle.

One or more strings are affixed to the instrument in step 206 by passing through individual, or collective, channels of the tail structure onto the saddle and further onto a tuning feature of the headstock. The string can be secured by one or more retention features of the string itself, such as a ball protrusion, or of the tailpiece, such as a groove, hole, tab, or protrusion. The string installation of step 206 results in the string continuously contacting the tailpiece, body, bridge member, saddle, nut, and tuning feature. The tension of an installed string is then adjusted in step 208 by articulating the tuning feature, such as by turning a knob, key, or screw.

It is contemplated that the articulation of the tuning feature can concurrently engage and secure a headpiece into physical contact with the headstock. That is, turning of a tuning feature can tighten both the attached string and the headpiece's position relative to the headstock. Alternatively, the headpiece can be physically secured to the headstock with one or more attachment means, such as an adhesive fastener, or magnets. The selective tensioning of a string in step 208 can be cyclically conducted for each string of the instrument to provide a desired pitch and sound.

While the saddle may be adjusted at any time during routine 200, some embodiments evaluate in decision 210 if an adjustment to the position and/or height of the saddle relative to a string is called for. If so, step 212 modifies the physical configuration of the saddle, which can provide customized intonation, stringpath, and string vibration capture performance of the instrument. At the conclusion of the saddle adjustment in step 212, or in the event no saddle adjustment is desired, step 214 proceeds to induce string vibration to produce musical sound with acoustic properties optimized by the physical structure of the instrument.

Through the various embodiments of the present disclosure, a stringed instrument can utilize optimized string energy capture via a tail structure in combination with a head structure. The passage of a string through a string channel that ensures continuous string contact with the bottom, body, and top of the instrument allows the saddle and nut to provide a stringpath that produces optimal acoustic characteristics. The ability to balance the weight, playability, and acoustic performance of an instrument through the configuration of the head structure, tail structure, and saddle allows for a diverse range of applications that optimally capture the energy of a moving string.

It is to be understood that even though numerous characteristics and advantages of various embodiments of the present disclosure have been set forth in the foregoing description, together with details of the structure and function of various embodiments of the disclosure, this detailed description is illustrative only, and changes may be made in detail, especially in matters of structure and arrangements of parts within the principles of the present disclosure to the full extent indicated by the broad general meaning of the terms in which the appended claims are expressed.

What is claimed is:

1. An apparatus comprising a string suspended over a body between a saddle and a nut, the string physically attached to the body via a tail structure defining an enclosed and at least partially curvilinear string channel extending from a tailpiece through the body to a bridge member that is physically connected to the tailpiece by at least one fastener.

2. The apparatus of claim 1, wherein the body is a semi-hollow electric instrument body.

3. The apparatus of claim 1, wherein the body is an acoustic instrument body.

4. The apparatus of claim 1, wherein the body is a solid body electric instrument body.

5. The apparatus of claim 1, wherein the bridge member is affixed to a first side of the body and the tailpiece is affixed to a second side of the body.

6. The apparatus of claim 1, wherein the at least one fastener comprises an adhesive.

7. The apparatus of claim 1, wherein the tailpiece secures the string with a retention notch.

8. The apparatus of claim 1, wherein the body comprises an internal cavity sized to complement the tail structure to increase string vibration capture.

9. The apparatus of claim 1, wherein the saddle comprises a saddle plate positioned in a saddle recess of the body.

10. The apparatus of claim 9, wherein the saddle is physically separated from the tail structure.

11. An instrument comprising a plurality of strings suspended over a body between a saddle and a nut, each string physically attached to the body via a tail structure and to a headstock via a head structure that continuously extends to contact opposite sides of the headstock, the tail structure defining an enclosed and continuously curvilinear string channel extending from a tailpiece through the body to a bridge member.

12. The instrument of claim 11, wherein the head structure clamps to the opposite sides of the headstock.

13. The instrument of claim 11, wherein the headstock comprises multiple separate tuning features tensioning the plurality of strings, the head structure physically engages less than all the tuning features of the headstock.

14. The instrument of claim 11, wherein the headstock comprises multiple separate tuning features tensioning the plurality of strings, the head structure physically engages each tuning feature of the headstock.

15. The instrument of claim 11, wherein the head structure has a size that is smaller than the outer dimensions of the headstock.

16. The instrument of claim 11, wherein the head structure is cantilevered from the headstock.

17. The instrument of claim 11, wherein the head structure comprises a headpiece physically attached to a second head member.

18. The instrument of claim 11, wherein the head structure has a weight that is greater than the headstock.

19. A method comprising:

attaching a tail structure to a body, the tail structure defining an enclosed and continuously curvilinear string channel extending from a tailpiece through the body to a bridge member that is physically connected to the tailpiece by at least one fastener;

inserting a string in the string channel, the string extending from the string channel to contact a saddle and a nut; and inducing a movement in the string to produce a predetermined sound, the movement corresponding with a predetermined stringpath in response to the configuration of the tail structure.

20. The method of claim 19, further comprising attaching a head structure to a headstock attached to the body, the head structure contacting at least one tuning feature of extending through the headstock.

* * * * *